United States Patent [19]

Bunch

[11] Patent Number: 4,926,569

[45] Date of Patent: May 22, 1990

[54] SHOE WITH CRADLE ARCH SUPPORT

[75] Inventor: Richard P. Bunch, Reading, Mass.

[73] Assignee: Converse Inc., North Reading, Mass.

[21] Appl. No.: 264,628

[22] Filed: Oct. 31, 1988

[51] Int. Cl.[5] ..... A43B 7/14; A43B 13/40

[52] U.S. Cl. ..... 36/91; 36/44; 128/611

[58] Field of Search ..... 36/91, 43, 44, 58.5, 36/88; 128/581, 611

[56] References Cited

U.S. PATENT DOCUMENTS

| | | | |
|---|---|---|---|
| 1,976,819 | 10/1934 | Weiler | 128/611 X |
| 2,068,251 | 1/1937 | Ullrich | 128/611 |
| 2,188,182 | 1/1940 | Gould | 128/611 |
| 4,694,590 | 9/1987 | Greenawalt | 36/91 |

FOREIGN PATENT DOCUMENTS

| | | | |
|---|---|---|---|
| 1050234 | 2/1959 | Fed. Rep. of Germany | 128/611 |
| 336807 | 10/1930 | United Kingdom | 128/611 |
| 478322 | 1/1938 | United Kingdom | 128/611 |

*Primary Examiner*—James Kee Chi

*Attorney, Agent, or Firm*—Bromberg & Sunstein

[57] ABSTRACT

A shoe including an arch support device that operates under tension to cradle the foot and lift the arch. In a preferred embodiment, the arch support arrangement includes an elastic strap attached on one end to the lateral portion of the top surface of the sole and on the other end to the upper by means of the lacing structure of the shoe and held in tension when the foot of the wearer is in the shoe and the lace is tightened. The degree of arch support can be adjusted by adjusting the tightness of the lacing. In another preferred embodiment, an insole with arch support padding may be placed into the shoe between the elastic strap and the foot of the wearer so that the strap and insole cradle and support the arch.

2 Claims, 5 Drawing Sheets

SHOE WITH CRADLE ARCH SUPPORT

TECHNICAL FIELD

The invention relates generally to shoes, and more specifically to shoes of the type provided with arch supports.

BACKGROUND OF THE INVENTION

The prior art includes several devices for removably attaching foot supports and insoles to soles of shoes. U.S. Pat. No. 4,316,333 describes a hook and looped pile fastener for removably fastening an arch support or other foot support device to the sole of a shoe; U.S. Pat. No. 3,686,779 describes a variety of detachable fasteners for fastening shoe components together, including the fastening of insoles and foot support devices to shoe soles. U.S. Pat. No. 2,865,097 discloses adhesive attachment of an insole to a shoe sole while U.S. Pat. No. 3,984,926 discloses adhesive attachment of a heel cushion to the sole of a shoe. These insoles and foot support devices do not provide adjustable degrees of support and do not cradle and lift the arch in addition to supporting it.

Other removable attachments of shoe components are disclosed by U.S. Pat. No. 3,099,884 and U.S. Pat. No. 2,292,556. U.S. Pat. No. 4,510,699 discloses an insole provided with two straps which wrap around the foot securing the insole to the foot and cradling it while U.S. Pat. No. 4,502,470 discloses a physiologic device used for treatment of poor circulation in the lower leg which attaches to the lower leg and cradles the foot of the wearer. Both of these devices are secured to the foot or leg of the wearer and not to the shoe and, therefore, do not provide anchored support of the foot in the shoe.

U.S. Pat. Nos. 4,649,939 and 4,313,433 describe straps secured to the shoe at one end under the foot which wrap around the shoe externally and are removably attached to the external face of the upper to provide support to the ankle or foot. The degree of support provided by each of these devices can be adjusted by wrapping the straps more tightly or loosely, but neither device cradles the foot and lifts the arch.

U.S. Pat. No. 3,837,098 discloses a shoe with an inner upper attached to the sole directly under the foot and attached to the outer upper through the lacing structure. This inner upper anchors the foot but does not provide arch support as it is attached to the sole along the centerline of the foot rather than under the lateral portion of the foot. Additionally, this inner upper is not easily removable from the sole. U.S. Pat. No. 1,743,689 discloses a boot with inner and outer upper portions connected to one another behind the heel. U.S. Pat. No. 1,471,035 describes detachable external trimmings of various colors which are attached to a shoe by means of the lacing structure for aesthetic purposes.

SUMMARY OF THE INVENTION

A shoe in accordance with the present invention includes an arch support device that operates under tension to cradle the foot and lift the arch. In a preferred embodiment, the device includes a strap of elastic material provided with means to removably attach the strap at one end to the sole in the lateral arch region thereof and attach the strap at its other end to the upper by means of the lacing structure of the shoe such that the strap is held in tension when the foot of the wearer is in the shoe thereby supporting the arch. In a further embodiment, a cushioned insole including arch support padding is removably attached at the lateral arch area of its bottom surface to the top face of the strap; the strap with the insole attached thereto is secured to the sole such that the insole lies between the strap and the foot and the strap and insole cradle the foot. The degree of tension in the strap in the embodiment, and thus the degree of support to the arch, may be adjusted by adjusting the tightness of the lacing of the shoe.

DESCRIPTION OF SPECIFIC EMBODIMENTS

The present invention provides an advantageous arch support system, wherein the wearer's arch is cradled and lifted in addition to being supported, and wherein there is provided means for adjusting the degrees of support. In a preferred embodiment of the arch support system, the arch support system is readily removable from the shoe. In addition to facilitating the adjustment of degrees of support, this removability feature permits the replacement of worn support elements, or the substitution of alternative arch support mechanisms.

Support is provided by an elastic cradle element that, in a preferred embodiment of the present invention, is attached to the inside of the shoe in such a way that the cradle is suspended underneath the wearer's arch. When the wearer's foot is inserted into the shoe, the cradle is urged against the wearer's arch, thereby providing support Because the cradle is elastic, the cradle readily conforms to the shape of the wearer's arch. In a preferred embodiment, the elasticity of the cradle can be adjusted to provide greater or lesser degrees of support.

Figure 1:
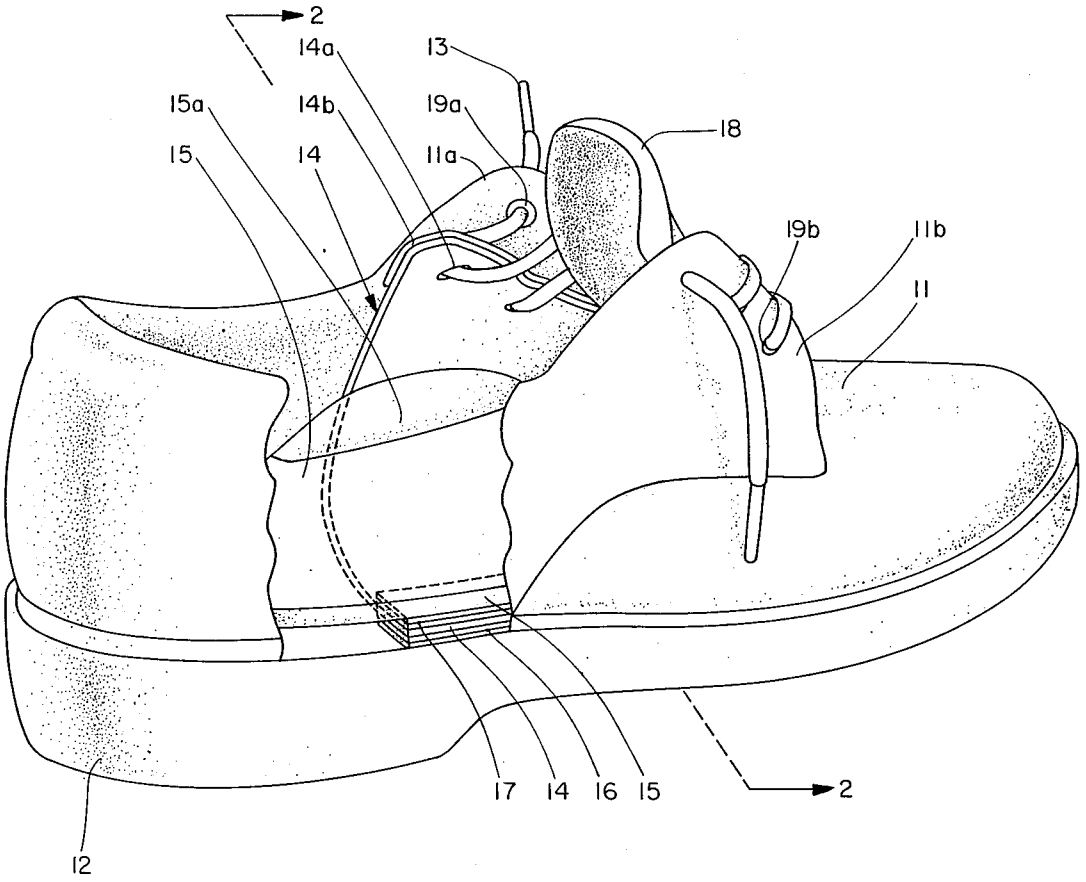
FIG. 1 is a partially cut away perspective view of a preferred embodiment of a shoe with cradle support according to the present invention.

FIG. 1 shows a shoe with an arch support system, according to a preferred embodiment of the present invention. The shoe includes a sole 12 that is affixed, using techniques known in the art, to an upper 11. The upper 11 includes a medial portion 11*a*, a lateral portion 11*b*, and a tongue 18. Medial portion 11*a* is provided with eyelets 19*a* for receiving shoe laces 13. Lateral portion 11*b* is provided with corresponding eyelets 19*b*.

Arch support is provided by strap 14, which according to the present invention, is preferably of an elastic material. In the present embodiment, the strap is substantially rectangular in shape, and is wide enough to provide support to a significant portion of the wearer's arch. It is contemplated that the strap will be of sufficient strength and durability to endure the ongoing stress that will be encountered during normal wear.

Strap 14 is affixed at its first end to the lateral edge of the top surface of sole 12 by first fastening means 16. As discussed further below, first fastening means 16 can take a variety of forms. Because in the present embodiment it is contemplated that the arch support is readily removable by the wearer, it is preferable to use detachable fastening means, such as hook and looped pile material, for the first fastening means 16. However, an alternative embodiment could include more permanent means for effecting the fastening of strap 14 to sole 12, such as stitching or rivets.

Strap 14 is provided with eyelets 14*a* at its second end. These eyelets correspond in size and spacing with medial upper eyelets 19*a*. Thus, strap 14 may be affixed at its second end to the medial portion of the upper 11*a*, by passing lace 13 through both strap eyelets 19*a* and medial upper eyelets 19*a*, in addition to passing lace 13 through lateral upper eyelets 19*b*. It will be seen that the present embodiment of the invention takes advantage of the conventional position of upper eyelets to provide a means for fastening the second end of strap 14. However, an alternative embodiment of the invention could provide separate fastening means for affixing the second end of strap 14 to upper 11.

Further support and cushioning are provided by insole 15, which is preferably made of polystyrene or similar material, and which overlays strap 14. Insole 15 includes arch support padding 15*a*, which supplements the arch support provided by strap 14. Because strap 14 is removable, it is possible for some wearers to remove strap 14 entirely, and rely solely on padding 15*a* for arch support. Insole 15 is preferably attached at its bottom face to the upper portion of the first end of strap 14 by means of a second fastening means 17.

Figure 2:
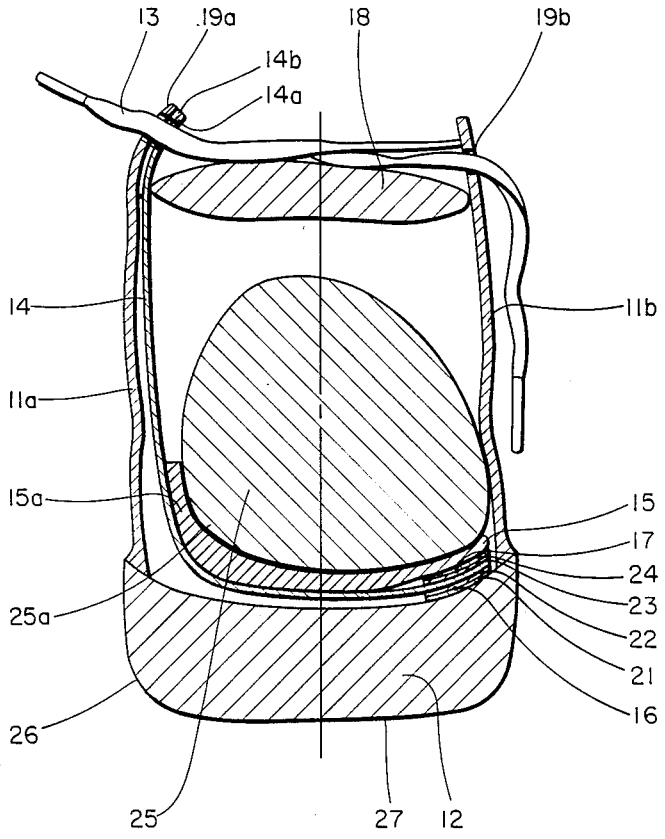
FIG. 2 is a cross section of the embodiment of FIG. 1 taken substantially along line 2—2 in FIG. 1, with a foot illustrated in the shoe and the shoe lace tightened.

FIG. 2 shows a cross section of the preferred embodiment shown in FIG. 1, and more clearly sets forth the physical relationship between the various elements discussed above. As seen in FIG. 2, insole 15 lies between strap 14 and the wearer's foot 25. Insole 15 and strap 14 together form a cradle arch support. The strap 14 is sufficiently short such that when the wearer's foot 25 is inserted into the shoe, and lace 13 is tightened, the strap is stretched and held in tension. The resilience of the strap results in a gentle lifting force being applied against the wearer's arch region 25*a*. The arch portion of the insole 15*a* supplements this lifting action by providing added padding and support.

Because one end of strap 14 is engaged by lace 13, the present embodiment provides a means whereby the degree of arch support can be easily adjusted by the wearer. Tightening or loosening lace 13 produces a corresponding tightening or loosening of strap 14, with a resulting increase or decrease in the degree of arch support. It should be borne in mind, however, that alternative embodiments are possible. For example, a second set of eyelets and a second lace could be provided on the upper for engaging the eyelets on the strap.

FIG. 2 further illustrates a preferred embodiment of first fastening means 16, and second fastening means 17. In this embodiment, each of fastening means 16 and 17 is a hook and looped pile type fastener, such as that sold under the trademark "Velcro." It should be noted that although fastening means 16 and 17 are illustrated in FIGS. 1–4 as having significant thickness, this is merely for clarity. In the actual shoe, these fastening means are thin enough so as to avoid foot discomfort.

Thus, first fastening means 16, which serves to anchor the first end of the strap 14 to sole 12, includes a first engageable fastening element 21 that is affixed to the sole using glue, stitching, or other means known in the art, and a second engageable fastening element 22 that is affixed to the bottom surface of strap 14. It will be seen that it would be possible to use either "hook" or "pile" material for the first fastening element 21 with the complementary material being used for the second fastening element 22.

Similarly, second fastening means 17, which serves to anchor insole 15 to strap 14, includes a first engageable fastening element 23 that is affixed to the top of the first end of strap 14 and a second engageable fastening element 24 that is affixed to the bottom of the insole 15. Again, it would be possible to use either "hook" or "pile" material for the first fastening element 23 with the complementary material being used for the second fastening element 24.

It will be appreciated that fastening means 16 and 17 need not be of the hook and looped pile type described above. Other removable attachment devices are within the scope of the invention. These could include, for example, adhesives, buckles, clips, and pin-and-socket arrangements would be within the scope of the invention. Another type of removable attachment arrangement includes providing a strip of hook and looped pile material at the second end of the strap, in place of the eyelets disclosed above. In that embodiment, a slit would be provided in the upper to receive the strip of hook and looped pile material. The strip would then be threaded through this slit in the upper, and then looped back on itself. A second mating strip of hook and looped pile material would be mounted onto the strap to engage the first hook and looped pile strip. Thus, instead of adjusting the tightness of the laces, the wearer would pull the first hook and looped pile strip until a proper degree of support was achieved, and then affix the first strip onto the second, mating strip.

It is also within the scope of the invention to permanently attach the first end of the strap to the lateral edge of the upper surface of the insole. It will be seen that in such an embodiment, it would still be possible to adjust the degree of support by manipulating the second end of the strap, which would still be removably attached.

Figure 3:
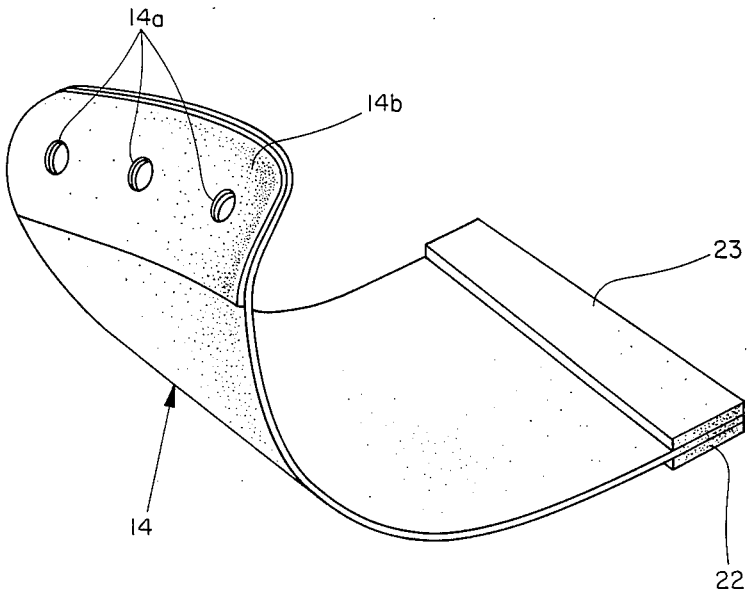
FIG. 3 is a perspective view of a preferred embodiment of an elastic strap arch support structure according to the present invention.

FIG. 3 shows a perspective view of a preferred embodiment of elastic strap 14. This embodiment includes reinforcement strip 14*b* at the second end of strap 14. Reinforcement strip 14*b* is made of a material that is tougher and more durable than the elastic strap material. Possible materials for making the reinforcement strip include leather or vinyl.

Reinforcement strip 14*b* serves many purposes. Because the elastic strap material is supple, attaching a non-reinforced strap to the medial side of the upper with a lace passed through eyelets 14*a* would result in uneven, and potentially uncomfortable support, as different portions of the strap are subjected to different amount of stretching. The use of reinforcement strip 14*b* insures a substantially uniform stretch along the entire width of the strap.

Second, a non-reinforced strap would be subjected to wear, both during lacing, and during normal use of the shoe. The greater durability of reinforcement strip 14*b* means that there will be significantly less wear on the elastic strap material. In addition, a reinforced strap would be easier to lace because eyelets 14*a* would more readily found, inasmuch as the relative position of the eyelets would remain substantially constant when reinforced.

It should be noted that although a substantially rectangular strap is shown, other shapes would be within the spirit of the invention. For example, it would be possible to use a shape that corresponded more closely with the shape of the wearer's arch region.

Figure 4:
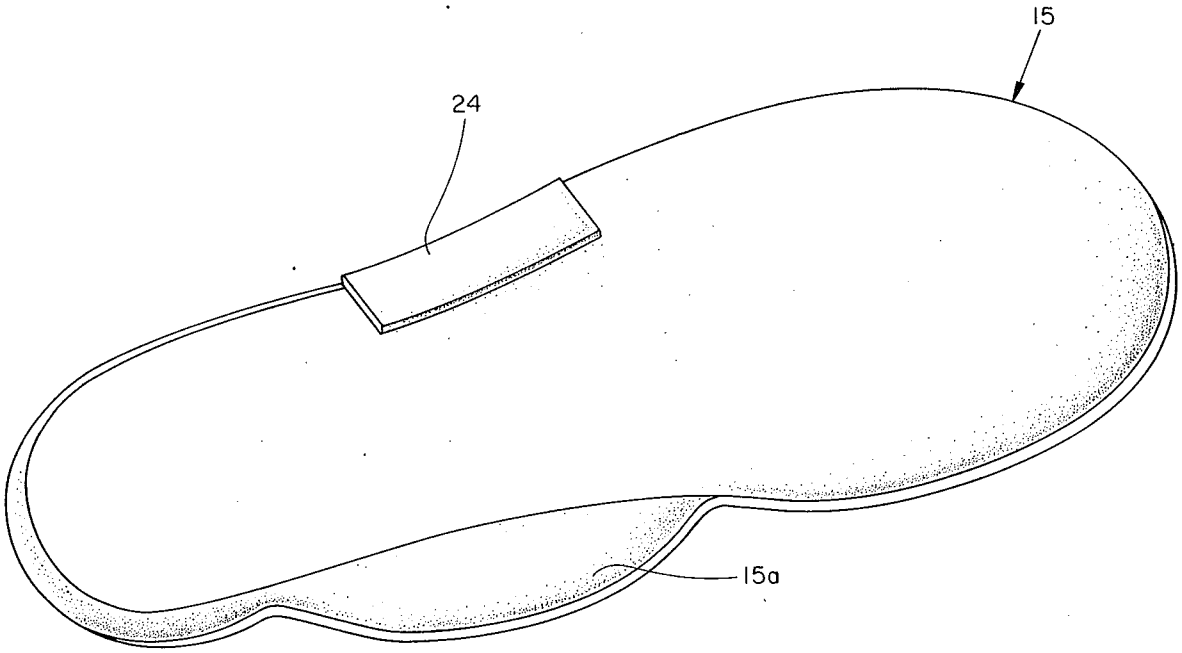
FIG. 4 is a perspective view of a preferred embodiment of an insole according to the present invention.

FIG. 4 shows a perspective view of a preferred embodiment of the bottom of insole 15. Second engageable fastener element 24 is affixed, using means known in the art, to the lateral edge of the arch region of the bottom surface of insole 15. As discussed above, second engageable fastener element 24 corresponds in position to, and engages with, a mating engageable fastener element on the upper surface of the second end of the arch support strap 14. Arch region 15*a* of insole 15 is provided with extra padding to facilitate cradling of the wearer's arch. The upper surface of insole 15 is shaped to conform generally to the sole of the wearer's foot.

Figure 5:
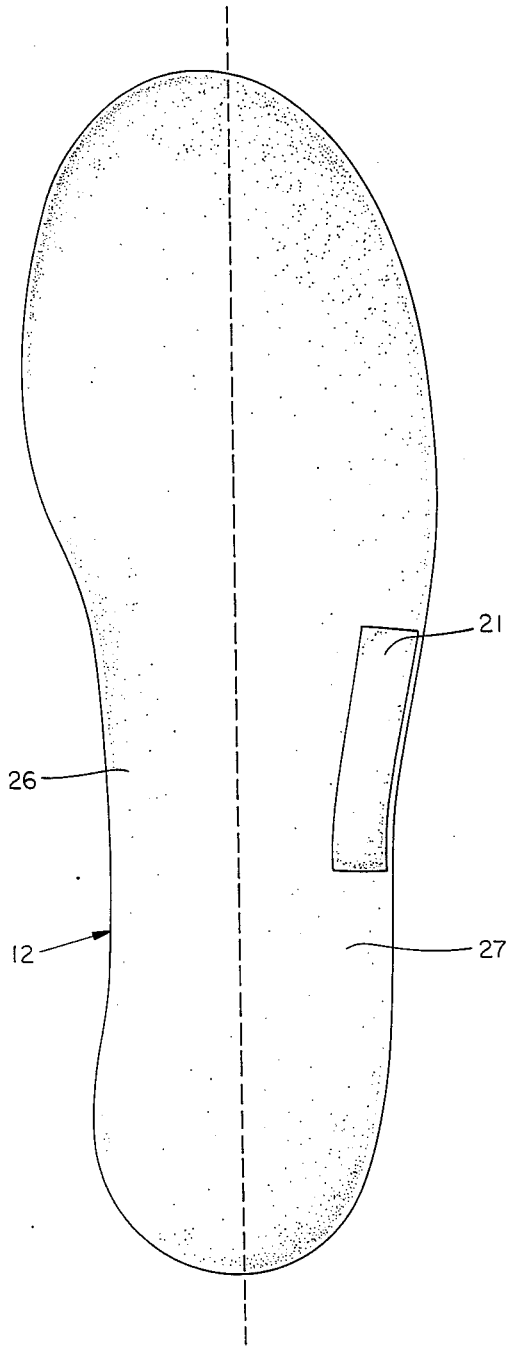
FIG. 5 is a top view of a prefrred embodiment of a sole according to the present invention.

FIG. 5 shows a top view of a preferred embodiment of sole 12. Sole 12 includes a medial region 26 and a lateral region 27. First fastening element 21 is provided in the lateral region 27 for receiving corresponding engageable fastening element 22 on the bottom surface of elastic strap 14. It will be seen that when the shoe is properly laced up, elastic strap 14 is suspended over medial region 26, thereby enabling strap 14 and insole 15 to lift and support the wearer's arch.

What is claimed is:

1. A shoe comprising:

a sole, having a medial region and a lateral region;

an upper attached to the sole;

an arch support device including an elastic strap having first and second ends, the first end having first attachment means for removably attaching such end to the sole at a sole attachment site, the second end being removably attached to the upper; and a cushioned insole disposed above the strap, such insole having arch support padding and second attachment means for removably attaching the insole to the strap at a strap attachment site;

so that the shoe may be readily reconfigured to be used either with an elastic strap to provide arch support via the cushioned insole or with the cushioned insole alone.

2. A shoe according to claim 1, wherein the sole and strap attachment sites are proximate to one another and the first and second attachment means each include a pair of mating members, each member being affixed to one of the removably attached items, the members being so configured that, when the strap is detached from the sole, the insole may be attached to the sole by mating the member affixed to the insole with the member affixed to the sole.

* * * * *